US007467644B2

(12) United States Patent
Blanco

(10) Patent No.: US 7,467,644 B2
(45) Date of Patent: Dec. 23, 2008

(54) REMOTE CONTROLLER FOR HEAVY CONSTRUCTION MACHINES WITH FOLLOWER PUSHROD

(75) Inventor: Marcel Blanco, Bron (FR)

(73) Assignee: Bosch Rexroth D.S.I., Venissieux (FR)

( * ) Notice: Subject to any disclaimer, the term of this patent is extended or adjusted under 35 U.S.C. 154(b) by 371 days.

(21) Appl. No.: 10/559,930

(22) PCT Filed: Jun. 24, 2004

(86) PCT No.: PCT/FR2004/001601

§ 371 (c)(1),
(2), (4) Date: Jan. 19, 2006

(87) PCT Pub. No.: WO2005/015031

PCT Pub. Date: Feb. 17, 2005

(65) Prior Publication Data

US 2006/0169498 A1 Aug. 3, 2006

(30) Foreign Application Priority Data

Jul. 11, 2003 (FR) ..... 03 08566
Feb. 25, 2004 (FR) ..... 04 01894

(51) Int. Cl.
*F15B 13/02* (2006.01)

(52) U.S. Cl. ..... 137/636.1; 137/636.2; 137/554; 137/556; 91/426

(58) Field of Classification Search ..... 137/636.1, 137/636.2, 554, 556, 553; 91/426
See application file for complete search history.

(56) References Cited

U.S. PATENT DOCUMENTS

| | | | | |
|---|---|---|---|---|
| 4,566,492 | A | 1/1986 | Bessard | |
| 5,010,263 | A | 4/1991 | Murata | |
| 5,140,320 | A * | 8/1992 | Gerbier et al. | 341/20 |
| 5,313,844 | A * | 5/1994 | Kadlicko | 73/861.54 |
| 5,320,123 | A * | 6/1994 | Corso et al. | 137/554 |
| 5,823,227 | A * | 10/1998 | Hori et al. | 137/636.1 |
| 6,786,237 | B2 * | 9/2004 | Yajima et al. | 137/554 |

FOREIGN PATENT DOCUMENTS

| | | |
|---|---|---|
| DE | 23 59 748 A1 | 6/1975 |
| DE | 199 35 101 A1 | 2/2000 |
| FR | 2 801 350 A1 | 5/2001 |

* cited by examiner

*Primary Examiner*—Kevin L Lee
(74) *Attorney, Agent, or Firm*—Oliff & Berridge, PLC

(57) ABSTRACT

The invention relates to a remote controller for heavy construction machines with a body, comprising a cavity, running between a first outlet end and a base, a first pushrod, running between a head and a base, arranged to slide with a back and forth movement in the cavity along an axial direction, a handle which may pivot with relation to the body, whereby a skirt of said handle is in direct contact with the head. The first pushrod may furthermore be moved to an extended position opposite to the depressed position with relation to the idle position thereof. First elastic return means are arranged in the cavity to force the pushrod into the extended position thereof and detection means are provided to detect the position of the first pushrod.

19 Claims, 7 Drawing Sheets

REMOTE CONTROLLER FOR HEAVY CONSTRUCTION MACHINES WITH FOLLOWER PUSHROD

BACKGROUND OF THE INVENTION

The present invention relates to the technical field of remote controls for heavy construction machines, particularly remote controls of the electrohydraulic type.

The invention relates more specifically to remote controls intended to control one or more receivers, particularly users of pressurized fluid, from a handle manipulated by the operator in order to transmit a control signal to said hydraulic receivers.

The remote controls customarily encountered on heavy construction machinery comprise:

- a body which comprises at least one cavity running between an open end opening onto at least a top face of the body and a bottom at the opposite end to the open end,
- at least one first pushrod which runs between a head end and a foot end, which is mounted to slide back and forth in said at least one cavity of the body in an axial direction between a rest position and a depressed position, and which is intended to control at least a first receiver external to the remote control, and
- a handle which comprises a transverse skirt and which is mounted to pivot with respect to the body opposite the top face of said body to control the back and forth movement of said first pushrod, the skirt simply resting against the head end of said pushrod, and the axis of the handle making a variable acute angle with the axis of the pushrod.

Even though such remote controls allow the movements of receivers to be controlled satisfactorily, they do require numerous component parts in as much as they have to have several pushrods each equipped with detection means to detect the position occupied by each of the pushrods between their rest position and their depressed position. The cost of such remote controls is therefore high and their reliability may be adversely affected by one of the numerous component parts.

SUMMARY

It is therefore an object of the present invention to remedy the aforementioned disadvantages by providing a remote control in which the number of component parts is reduced while at the same time maintaining the same functionalities. To this end, according to the present invention, the remote control of the aforementioned type is essentially characterized in that at least the head end of the first pushrod can also move toward a protruding position which is on the opposite side of said rest position to the depressed position, in that first elastic return means urge the head end of the pushrod toward its protruding position so that at least the head end of the first pushrod has an autonomous upward movement, and in that the remote control further comprises detection means for detecting the position occupied by the head end of the first pushrod between its protruding and depressed positions.

Thus, by virtue of these measures, the number of pushrods equipped with detection means is reduced because just one pushrod is needed rather than the two pushrods present in remote controls of the prior art.

Advantageously, the detection means are of the type free of mechanical contact.

As a preference, the detection means comprise a magnet which moves as one with the head end of the pushrod.

According to one possibility, the cavity is stepped and comprises a first shoulder more or less transverse to the movement of the first pushrod, and said pushrod comprises an intermediate portion which moves as one with the head end and the foot end of the pushrod and is located between its head end and its foot end and delimits a top stop and a bottom stop, the top stop coming to rest against the first shoulder when the pushrod is in the protruding position and the bottom stop coming to rest against the bottom of the cavity when said pushrod is in the depressed position.

As a preference, the first return means are housed in the cavity.

Again as a preference, the first return means comprise a collar borne by the intermediate portion near the top stop and a first compression spring inserted between the collar and the bottom of the cavity.

According to another possibility, the cavity comprises a shoulder substantially transverse to the movement of the first pushrod, and said pushrod comprises a head end and a foot end that move together as one and are able to move translationally along the axis of the pushrod with respect to an intermediate portion which is situated between the head end and the foot end and delimits a top stop and a bottom stop, the top stop coming to rest against the shoulder when the head end of the pushrod is between its rest position and its protruding position and the bottom stop coming to rest against the bottom of the cavity when said pushrod is in the depressed position.

For preference, the first elastic return means are housed between the head end of the pushrod and the intermediate portion of the pushrod.

According to one embodiment, the first elastic return means comprise a first compression spring inserted between the head end of the pushrod and the intermediate portion of the pushrod.

Advantageously, second elastic return means are housed in the cavity to return the first pushrod from its depressed position to its rest position.

According to one possibility, the second return means comprise a ring concentric with the first pushrod, a second compression spring inserted between the ring and the bottom of the cavity, and a peripheral relief moving as one with the first pushrod and intended to come to rest against the ring, the cavity further comprising a second shoulder against which the ring abuts when the first pushrod is in the rest position.

According to another possibility, the second return means comprise a collar borne by the intermediate portion near the top stop and a second compression spring inserted between the collar and the bottom of the cavity.

Advantageously, a second pushrod is mounted in a second cavity of the body, the second pushrod being elastically urged by a third compression spring in such a way that the force that has to be exerted on the handle in order to depress one of the first and second pushrods is substantially constant.

According to one embodiment, the second cavity is symmetric with the first cavity with respect to the axis of the handle in the rest position.

Advantageously, at least the head end of the second pushrod is able to move toward a protruding position which is on the opposite side of said rest position to the depressed position and elastic return means urge the head end of the pushrod toward its protruding position so that at least the head end of the second pushrod has an autonomous upward movement.

According to one embodiment, the foot end of the first pushrod is mounted such that it passes through the bottom of the cavity and internally bears the magnet.

Advantageously, a Hall-effect sensor is mounted in the body of the remote control facing the movement of the magnet between the depressed and protruding positions of the first pushrod is depressed and protruding.

According to one embodiment, the second pushrod is located on the opposite side of the axis of the handle to the first pushrod.

Advantageously, the Hall-effect sensor is potted in resin so that it is situated in a sealed location.

In any event, the invention will be clearly understood with the aid of the description which follows, with reference to the attached schematic drawing which, by way of nonlimiting example, depicts three embodiments of the remote control according to the present invention.

BRRIEF DESCRPTJON OF THE DRAWINGS

DETAILED DESCRIPTION OF THE PREFERRED EMBODIMENT

Figure 1:
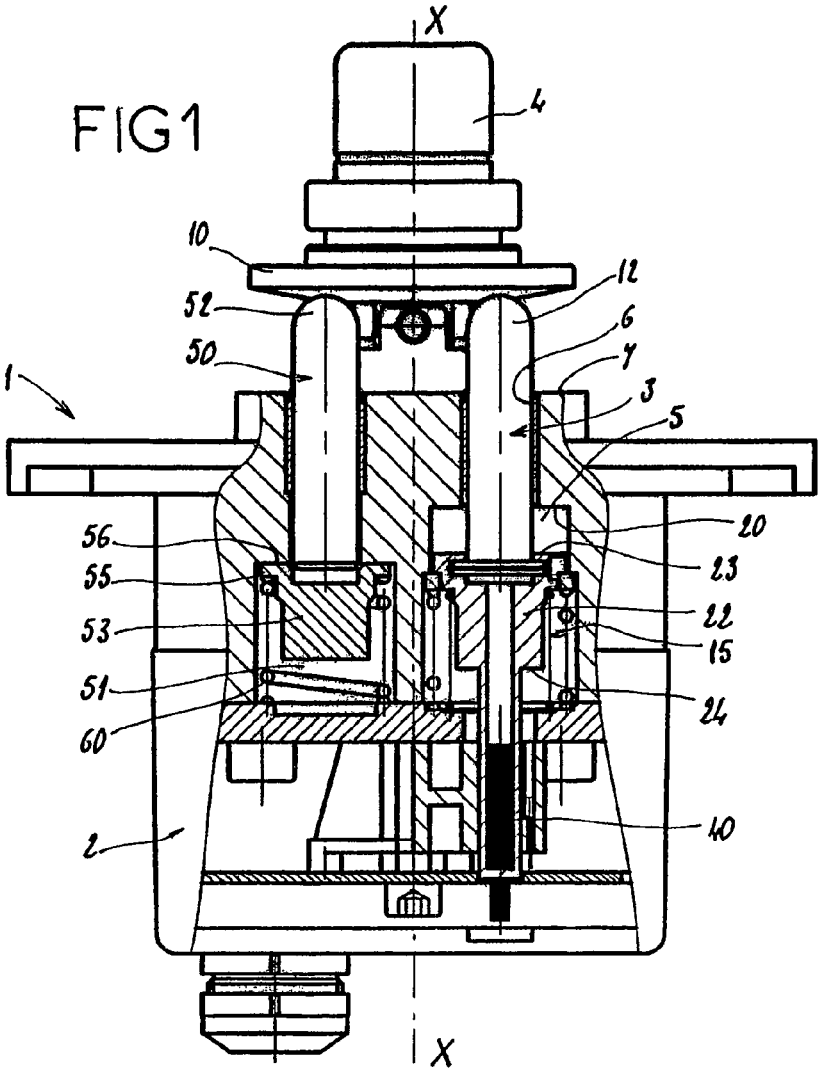
FIG. 1 is a view in longitudinal section of the remote control according to a first embodiment.

FIG. 1 depicts a remote control 1 for heavy construction machines which comprises, in a way known per se, a body 2, at least one first pushrod 3 which is mounted to slide in the body 2 and a handle 4 which is mounted to pivot with respect to this body to control the back and forth movements of the first pushrod 3 inside the body 2.

The first pushrod 3 is mounted to slide inside a first cavity 5 which runs between an open end 6 opening onto at least a top face 7 of the body 2 and a bottom 8 at the opposite end to this open end 6.

The body 2 has a longitudinal axis X-X and the first pushrod 3 slides parallel to this axis X-X.

Figure 2:
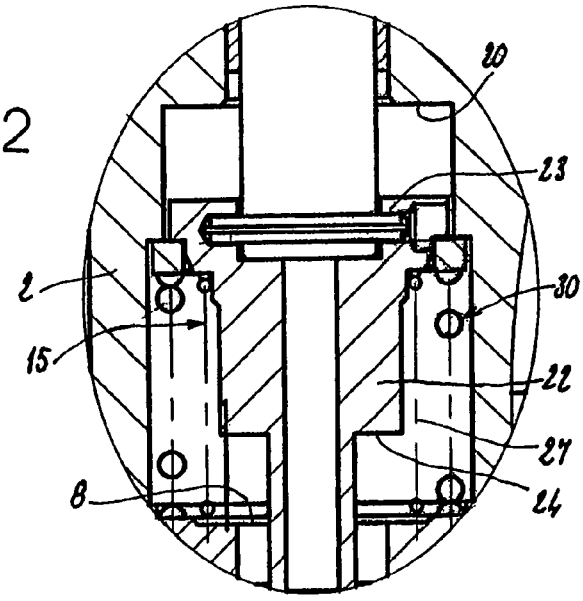
FIG. 2 is an enlarged view of the first pushrod of FIG. 1.

The handle 4 is mounted so that it can pivot with respect to the body 2, facing the top face 7 of this body, to control the back and forth movements of said first pushrod 3. This handle 4 has an axis Y-Y and possesses a transverse skirt 10 which allows said at least one first pushrod 3, to be controlled. The axis Y-Y of the handle 4 forms a variable acute angle with the axis of the pushrod 3 which angle is dependent on the position to be given to the pushrod. When the handle 4 is in the rest position, it runs along the axis X-X of the body 2 as depicted in FIGS. 1 and 2. The positions of the handle depicted in FIGS. 3 and 5 allow said first pushrod 3 to be commanded into its depressed position and into its protruding position, respectively.

To this end, said pushrod 3 runs between a head end 12 and a foot end 13. The head end 12 is mounted so that it can move back and forth at the open end 6 of the body 2 so that the skirt 10 of the handle 4 simply rests on this head end 12. The foot end 13 of the pushrod 3 is housed in the bottom 8 of the cavity 5 to control at least a first receiver external to the remote control.

Figure 3:
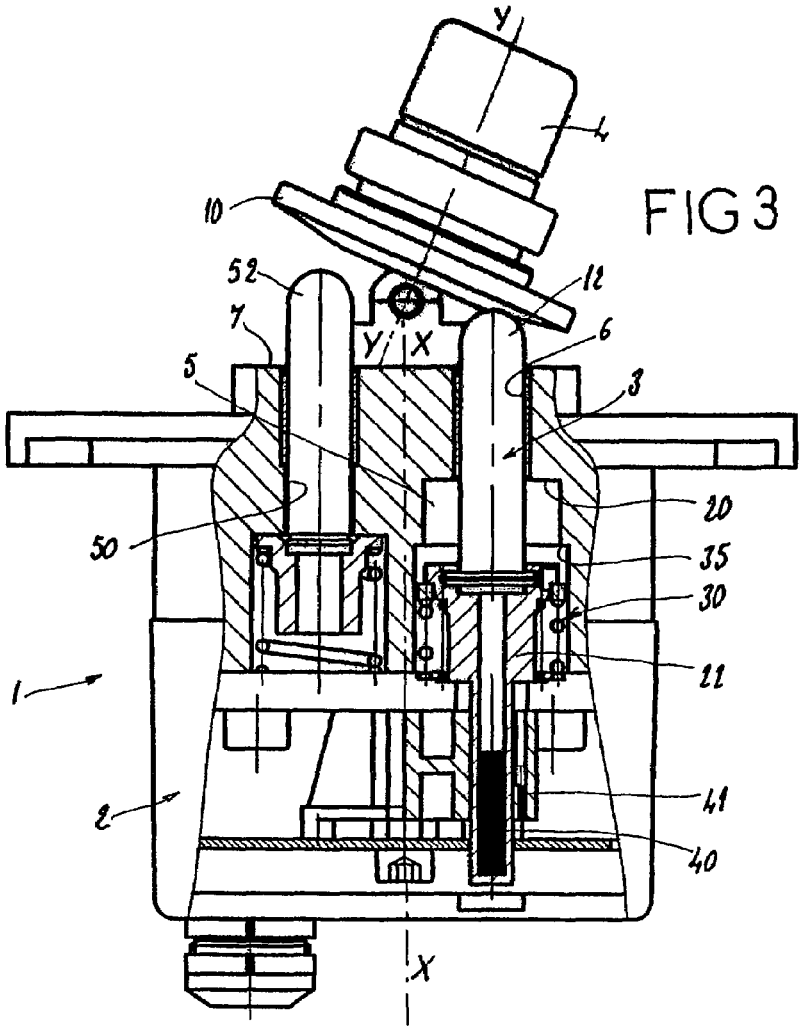
FIGS. 3 and 4 are views similar to those of FIGS. 1 and 2, the handle having been pivoted to move the first pushrod into its depressed position.
Figure 4:
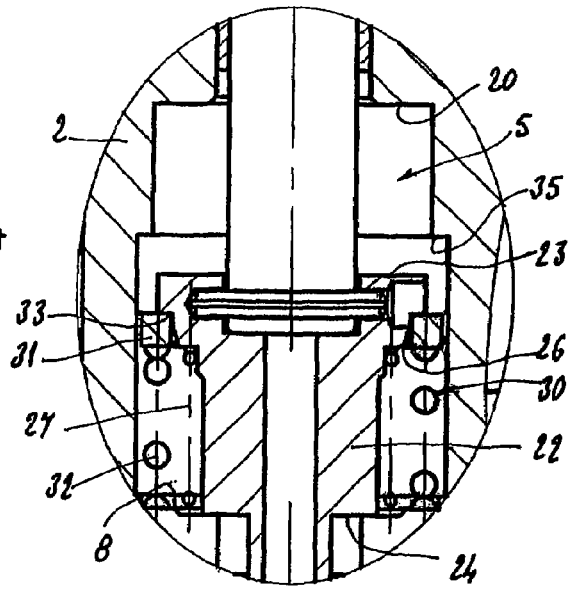

The head end 12 of the first pushrod 3 abuts against the underside of the skirt 10 of the handle 4 and is commanded between its rest position as depicted in FIGS. 1 and 2 and its depressed position as depicted in FIGS. 3 and 4 in a way well known in the state of the art.

Figure 5:
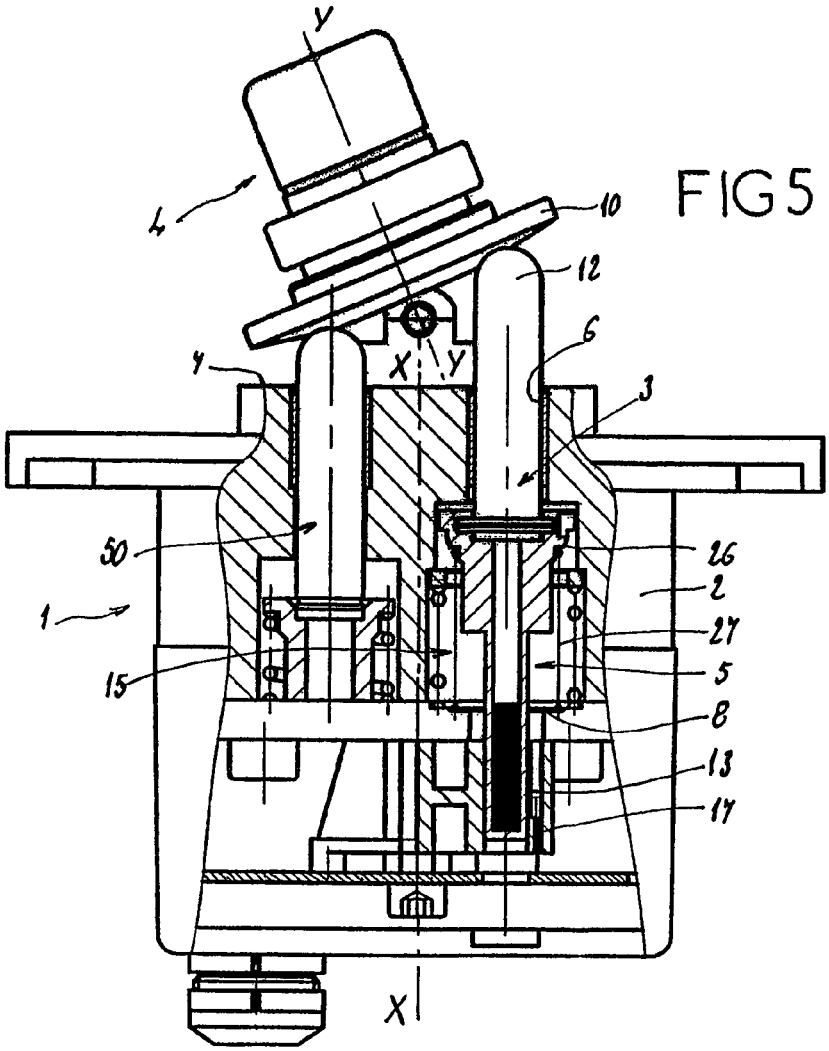
FIGS. 5 and 6 are views similar to those of FIGS. 1 and 2, the handle having been pivoted toward the opposite position to allow the first pushrod to move into its protruding position.
Figure 6:
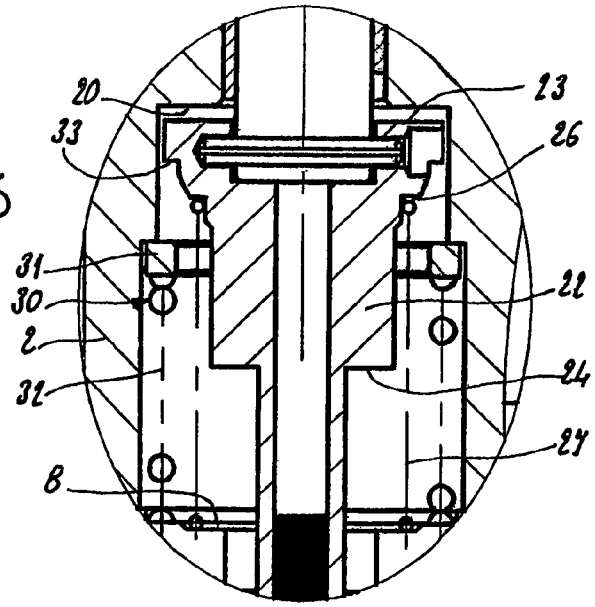

According to an essential feature of the present invention, this first pushrod 3 can also move into a protruding position as depicted in FIGS. 5 and 6, this protruding position being on the opposite side of the rest position to the depressed position.

To do this, the remote control according to the present invention has first elastic return means 15 which are housed in the cavity 5 to urge the first pushrod 3 into its protruding position so that this pushrod has its own inherent upward movement. During this upward movement, the handle 4 is pivoted in such a way as to disengage the head end 12 of the pushrod 3 so that this head end 12 has an upward movement to follow the skirt 10 simply under the action of the first elastic return means 15.

Furthermore, in order to control said first external receiver, the remote control 1 further comprises detection means 17 to detect any position occupied by this first pushrod 3 between its protruding and depressed positions.

As a preference, the cavity 5 is stepped and comprises a first shoulder 20 situated under the open end 6 and running substantially transversely to the movement of the first pushrod 3, that is to say more or less at right angles to the axis X-X. Furthermore, the pushrod 3 has an intermediate portion 22 which is of larger diameter than the head end 12 and the foot end 13 of this pushrod and is installed along the length of said pushrod. In this embodiment, the head end 12, the foot end 13 and the intermediate portion 22 move as one. This intermediate portion thus has a top face 23 which delimits a top stop and a bottom face 24 which delimits a bottom stop. The top face 23 faces toward the first shoulder 20 while the bottom face 24 faces toward the bottom 8 of the cavity 5.

Thus, as the pushrod 3 moves back and forth inside this cavity 5, the top stop 23 is intended to come to rest against the first shoulder 20 as depicted in FIGS. 5 and 6 to define the protruding position of this pushrod 3 while the bottom stop 24 is intended to come to rest against the bottom 8 of this cavity when the pushrod is in the depressed position as depicted in FIGS. 3 and 4.

The first return means 15 preferably comprise a collar 26 borne by the intermediate portion 22 near the top stop 23, this collar facing toward the bottom 8 of the cavity 5. The first elastic return means 15 also comprise a first compression spring 27 inserted between the collar 26 and the bottom 8 of the cavity 5. This compression spring 27 has a diameter slightly greater than that of the intermediate portion 22 so that it can be pushed onto this portion until it reaches the collar 26.

Thus, the first pushrod 3 has an upward movement imposed on it by the first compression spring 27 so that when the head end 12 of this pushrod 3 is disengaged by the skirt 10 of the handle 4, the pushrod 3 has an upward movement into its protruding position by virtue of the compression means 27.

Furthermore, according to another feature of the invention, the remote control 1 has second elastic return means 30 housed in the cavity 5 to return this first pushrod 3 from its depressed position as depicted in FIGS. 3 and 4 to its rest position as depicted in FIGS. 1 and 2.

As shown more particularly by FIGS. 3 and 4, the second elastic return means 30 comprise a ring 31 concentric to the first pushrod 3, a second compression spring 32 inserted between the ring 31 and the bottom 8 of the cavity 5, and a peripheral relief 33 which moves as one with the first pushrod 3 and is intended to come to rest against the ring 31. Furthermore, the cavity 5 has a second shoulder 35 situated at a level somewhere between the first shoulder 20 and the bottom 8 of the cavity 5. The second compression spring 32 urges the ring 31 toward the second shoulder 35 so that this ring 31 comes into abutment against this second shoulder when the first pushrod 3 is in its rest position as depicted in FIGS. 1 and 2. The second shoulder 35 thus somewhat defines the rest position of the pushrod 3.

The pushrod 3 is thus in equilibrium in its rest position between the action exerted by the skirt 10 on the head end 12, which tends to depress the pushrod 3, and the action of the first compression spring and of the second compression spring 27 and 32. In this rest position, the ring 31 is in abutment against the second shoulder 35 while the peripheral relief 33 is in abutment against this ring 31 under the action of the handle 4.

When the pushrod 3 is in its depressed position as depicted in FIGS. 3 and 4, the skirt 10 of the handle 4 urges the head end 12 of the pushrod 3 downward so that the intermediate portion 22 drives the concentric ring 31 in a downward movement and compresses the compression springs 27 and 32 until this intermediate portion 22 comes into abutment downward against the bottom 8 of the cavity 5.

Conversely, when the pushrod 3 is in its protruding position as depicted in FIGS. 5 and 6, the head end 12 of this pushrod has been disengaged by the skirt 10 of the handle 4 so that the intermediate portion 22 has come into abutment upward against the first shoulder 20 under the action of the first compression spring 27. During the return movement from the depressed position to the protruding position the compression springs 27 and 32 relax. The concentric ring 31 comes into abutment against the second shoulder 35 of the cavity 5 while the peripheral relief 33 is no longer in contact with the ring 31 when the pushrod moves from its rest position to its protruding position.

The pushrod 3 occupies any position between its depressed position and its protruding position according to the inclination given to the handle 4.

The foot end 13 of the pushrod 3 extends beyond the bottom 8 of the cavity 5 so that it passes through this bottom in a back and forth movement between its protruding and depressed positions.

As a preference, the detection means 17 are of the type free of mechanical contact and for example comprise a magnet 40 that moves as one with the pushrod 3 by being mounted inside the foot end 13 of this pushrod, together with a Hall-effect sensor 41 which is mounted in the body 2 of the remote control 1, facing the movement of the magnet 40 between the depressed and protruding positions of the first pushrod 3. More specifically, the Hall-effect sensor 41 is mounted in the body 2 beyond the bottom 8 of the cavity 5. Thus, this sensor 41 can be potted in a substance such as resin in order to seal it.

Furthermore, even though this first pushrod 3 is able by itself to control a first receiver, a second pushrod 50 is installed in the body 2 of the remote control 1 in order to balance the handle 4. This second pushrod 50 is a passive pushrod in as much as it is unable to transmit a control signal to a receiver. It is installed in a cavity 51 formed in the body 2 on the opposite side of the axis of the handle 4 to the first cavity 5. This second pushrod 50 also has a head end 52 coming to rest under the skirt 10 of the handle 4 and a foot end 53. This foot end 53 butts against the bottom of the second cavity 51 and has a collar 53 that butts against the top part 56 of the cavity 51. This cavity 51 runs parallel to the axis X-X and between the levels defined by the bottom 8 of the first cavity 5 and the rest position defined by the second shoulder 35 of the first cavity 5.

This second pushrod 50 is urged by a third compression spring 60 inserted between the collar 55 and the bottom of this cavity so as to elastically urge this second pushrod 50 and cause the operator to have to exert the same force on the handle 4 when depressing the first pushrod 3 or the second pushrod 50.

Thus, only the first pushrod 3 is equipped with means for controlling a receiver while the second pushrod 50 is simply there for the sake of the symmetry of the forces that have to be exerted on the handle 4. The number of component parts is thus reduced so as to minimize the cost and the risks of technical failure.

Furthermore, a positive mechanical connection may also be created between the head end 12 of the pushrod 3 to guard against any possible failure of one of the compression springs or the event that the pushrod 3 remains jammed during its upward movement.

Figure 7:
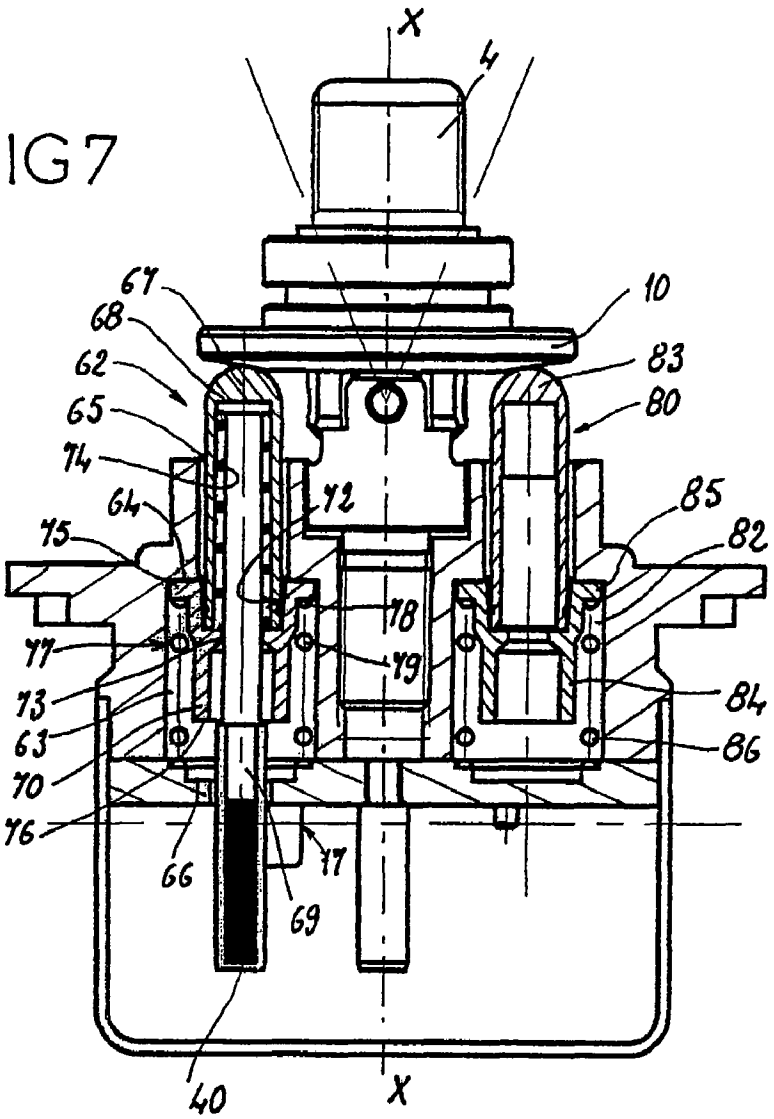
FIG. 7 is a view in longitudinal section of the remote control according to a second embodiment.
Figure 9:
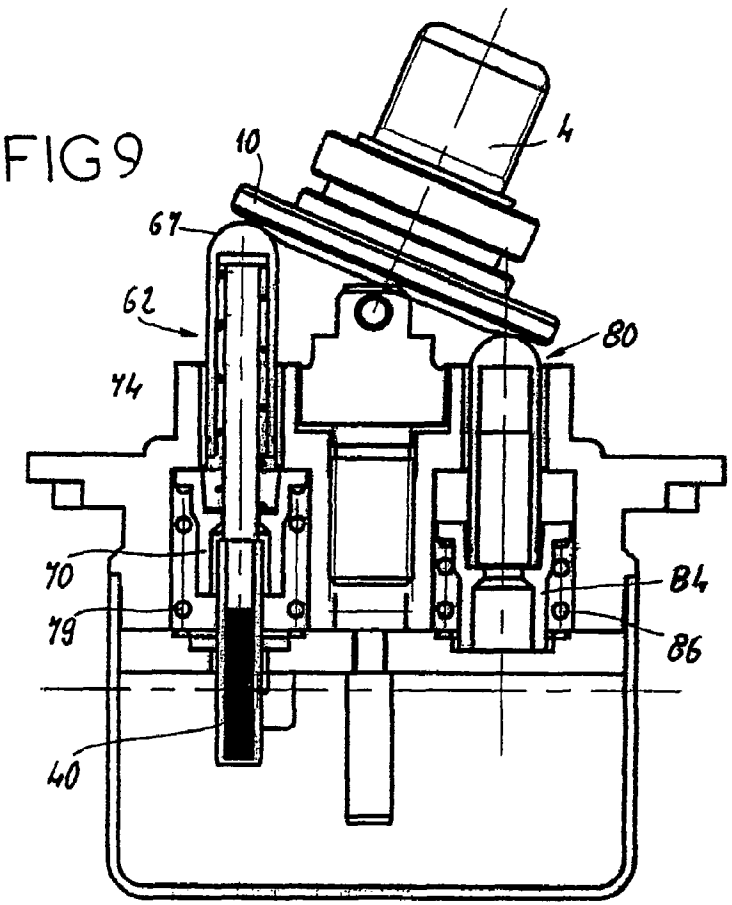
FIG. 9 is a view similar to that of FIG. 7, the handle having been pivoted to the opposite position to allow the head end of the first pushrod to move into its protruding position.
Figure 8:
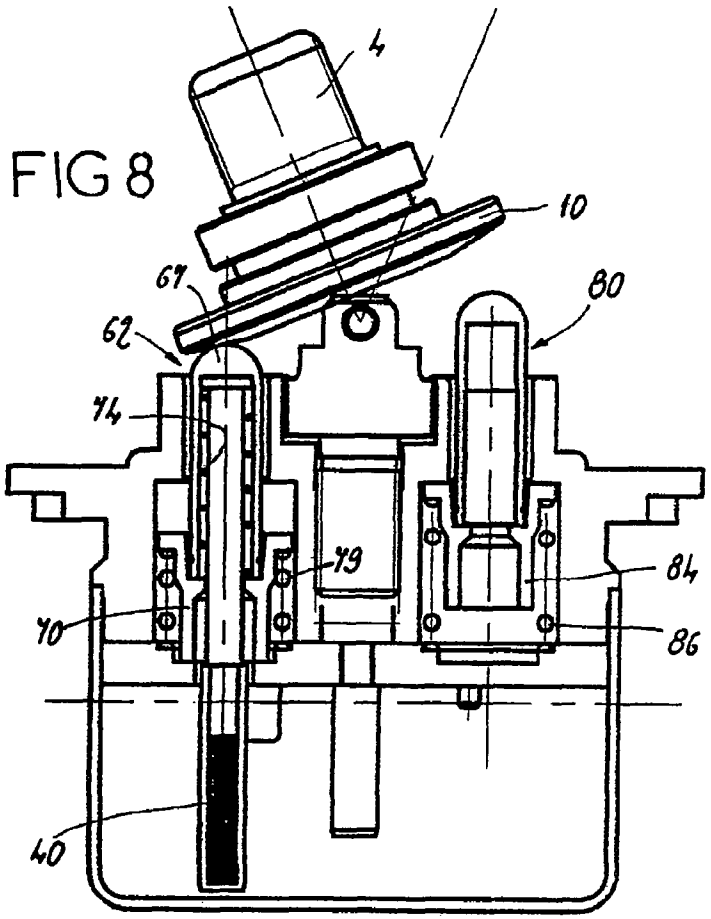
FIG. 8 is a view similar to that of FIG. 7, the handle having been pivoted to move the first pushrod into its depressed position.

According to a second embodiment of the invention depicted in FIGS. 7 to 9, the remote control 1 for heavy construction machines comprises, as in the first embodiment and as known per se, a body 2, at least one first pushrod 62 which is mounted to slide in the body 2 and a handle 4 which is mounted to pivot with respect to this body to control the back and forth movements of the first pushrod 62 inside the body 2.

The first pushrod 62 is mounted to slide inside a first cavity 63 which runs between an open end 65 opening onto at least a top face 7 of the body 2 and a bottom 66 at the opposite end to this open end 65.

As a preference, the cavity 63 comprises a shoulder 64 situated below the open end 65 and running substantially transversely with respect to the movement of the first pushrod 62, that is to say substantially at right angles to the axis X-X.

In this embodiment, the pushrod 62 comprises:

- a head end 67 produced in the form of a cap comprising a cylindrical housing closed at its end 68 intended to be in contact with the skirt 10 of the handle 4, forming a closed end,
- a foot end 69 produced in the form of a cylindrical rod of a diameter smaller than the housing in the head end 67 fixed to the closed end of the latter coaxially via one of its ends,
- an intermediate portion 70, of cylindrical overall shape, comprising a cylindrical housing 72 to accommodate the opposite end of the cap that constitutes the head end 67 to the end that is intended to be in contact with the handle 4.

The closed end of the housing 72 comprises a central opening 73 of axis XX and with a diameter more or less equal to the rod of the foot end 69 allowing the latter to pass.

This arrangement guarantees that the foot end 69 and the head end 67 move as one, and can move translationally along the axis XX with respect to the intermediate portion 70.

The head end 67 of the first pushrod 62 comes into abutment under the skirt 10 of the handle 4 and is commanded between its rest position as depicted in FIG. 7 and its depressed position as depicted in FIG. 8 in the way well known in the state of the art.

The foot end 69 of the pushrod 62 is housed in the bottom 66 of the cavity 63 to control at least one first receiver external to the remote control.

According to an essential feature of the present invention, the head end 67 of the first pushrod 62 can also move into a protruding position as depicted in FIG. 9, this protruding position being on the opposite side of the rest position to the depressed position.

To this end, the remote control according to the present invention has first elastic return means 74 consisting of a spring 74 housed axially between the bottom of the housing 72 and the closed end 68 of the cap that forms the head 67.

The first elastic return means 74 urge the head end 67 of the first pushrod 62 into its protruding position so that the head end 67 of the pushrod 62 has its own inherent upward movement. During this upward movement, the handle 4 is pivoted to disengage the head end 67 of the pushrod 62 so that this head end 67 has an upward movement to follow the skirt 10 under the action of the first elastic return means 74 into its protruding position.

The intermediate portion 70 has a top face 75 which delimits a top stop and a bottom face 76 which delimits a bottom stop. The top face 75 faces toward the shoulder 64 while the bottom face 76 faces toward the bottom 66 of the cavity 63.

Thus, during the back and forth movements of the pushrod 62 inside this cavity 63, the top stop 75 is intended to come to rest against the shoulder 64 as depicted in FIGS. 7 and 9 when the pushrod is not in the depressed position, while the bottom stop 76 is intended to come to rest against the bottom 66 of this cavity when the pushrod is in the depressed position as depicted in FIG. 8.

The shoulder 64 thus somewhat defines the rest position of the pushrod 62.

Furthermore, according to another essential feature of the invention, the remote control 1 has second elastic return means 77 which are housed in the cavity 63 to return this first pushrod 62 from its depressed position as depicted in FIG. 8 to its rest position as depicted in FIG. 7.

The second return means 77 preferably comprise a collar 78 borne by the intermediate portion 70 near the top stop 75, this collar facing toward the bottom 66 of the cavity 63. The second elastic return means 77 also comprise a second compression spring 79 which is inserted between the collar 78 and the bottom 66 of the cavity 63. This compression spring 79 has a diameter slightly larger than that of the intermediate portion 70 so that it can be pushed onto this portion until it reaches the collar 78.

As in the first embodiment, in order to control said first external receiver, the remote control 1 comprises detection means 17 for detecting any position occupied by this first pushrod 62 between its protruding and depressed positions.

The pushrod 62 is in equilibrium in its rest position between the action exerted by the skirt 10 on the head end 67 which tends to depress the pushrod 62 and the action of the first compression spring and of the second compression spring 74 and 79. In this rest position, the top stop 75 rests against the shoulder 64 while the head end 67 abuts axially against the closed end of the housing 72 of the intermediate portion 70 under the action of the handle 4. The first spring 74 is compressed.

When the pushrod 62 is in its depressed position as depicted in FIG. 8, the skirt 10 of the handle 4 urges the head end 67 of the pushrod 62 downward so that the intermediate portion 70 compresses the second compression spring 79 until this intermediate portion 70 is in abutment downward against the bottom 66 of the cavity 63.

Conversely, when the head end of the pushrod 62 is in its protruding position as depicted in FIG. 9, the head end 67 of this pushrod has been disengaged by the skirt 10 of the handle 4 so that the intermediate portion 70 has come into abutment upward against the shoulder 64 under the action of the second compression spring 79. Likewise, the first compression spring 79 relaxes. The head end 67 is no longer axially in abutment against the closed end of the housing 72 of the intermediate portion 70 when the head end 67 of the pushrod moves from its rest position into its protruding position.

The head end 67 of the pushrod 62 can occupy any position between its depressed position and its protruding position depending on the inclination given to the handle 4.

The foot end 69 of the pushrod 62 extends beyond the bottom 66 of the cavity 63 so as to pass through this bottom in the back and forth movement between its protruding and depressed positions.

As a preference, as in the first embodiment, the detection means 17 are of the type free of mechanical contact and comprise for example a magnet 40 which moves as one with the foot end of the pushrod 62 by being mounted inside the latter, and a Hall-effect sensor 41 mounted in the body 2 of the remote control 1 facing the movement of the magnet 40 between the depressed and protruding positions of the first pushrod 62. More specifically, the Hall-effect sensor 41 is mounted in the body 2, beyond the bottom 66 of the cavity 63. Thus, this sensor 41 may be potted in a substance such as resin in order to seal it.

To balance the handle 4 and in a similar way to the first embodiment, a second pushrod 80 is installed in the body 2 of the remote control 1 to balance the handle 4. This second pushrod 80 is a passive pushrod in as much as it is unable to transmit a control signal to a receiver. It is installed in a cavity 82 formed in the body 2 on the opposite side of the axis of the handle 4 to the first cavity 63.

This cavity 82 is symmetric with the first cavity 63 about the axis of the handle. It comprises a shoulder 86 symmetric with the shoulder 64 of the first cavity. The bottom of this cavity is not pierced like the first cavity 63.

This second pushrod 80 also has a head end 83 coming to rest under the skirt 10 of the handle 4 and a portion 84 secured to the head end 83. In this second embodiment, the portion 84 of the second pushrod 80 is identical to the intermediate portion 70 of the first pushrod, and the head end 83 of the second pushrod is identical to that head end 67 of the first pushrod 62, these two parts however being joined together, unlike the first pushrod 62.

This portion 84 butts against the bottom of the second cavity 82 and has a collar 85 that butts against the shoulder 86 of the cavity 82. This cavity 82 runs parallel to the axis X-X and between the levels defined by the bottom 66 of the first cavity 63 and the rest position defined by the shoulder 64 of the first cavity 63.

Furthermore, this second pushrod 80 is urged by a third compression spring 86, identical to the first compression spring 74, which is inserted between the collar 85 and the bottom of this cavity so as to urge this second pushrod 80 elastically and cause the operator to have to exert the same force on the handle 4 to depress the first pushrod 62 or the second pushrod 80.

The number of component parts is reduced by comparison with the first embodiment so as to minimize the cost and the risk of technical failure.

The assembly of a remote control according to this second embodiment is simplified by the use of components that are the same for the first and for the second pushrods.

Furthermore, the travel of the first compression spring is reduced by comparison with the first embodiment.

Figure 10:
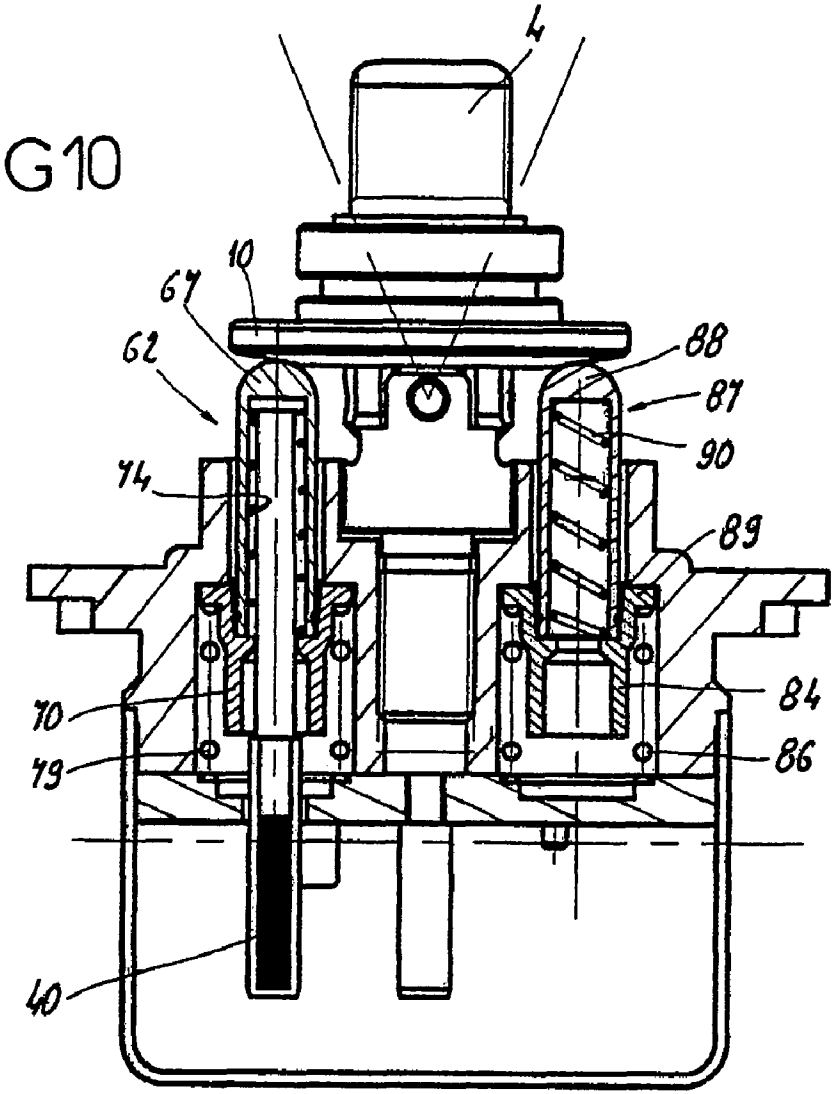
FIG. 10 is a view in longitudinal section of the remote control according to a third embodiment.
Figure 12:
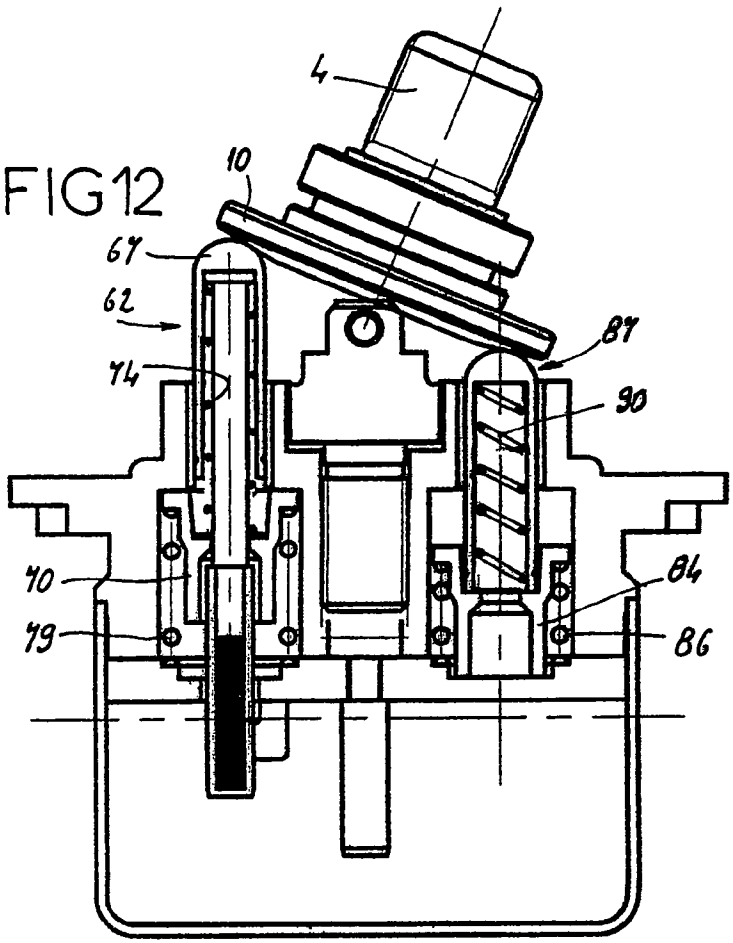
FIG. 12 is a view similar to that of FIG. 10, the handle having been pivoted into the opposite position to allow the head end of the first pushrod to move into its protruding position.
Figure 11:
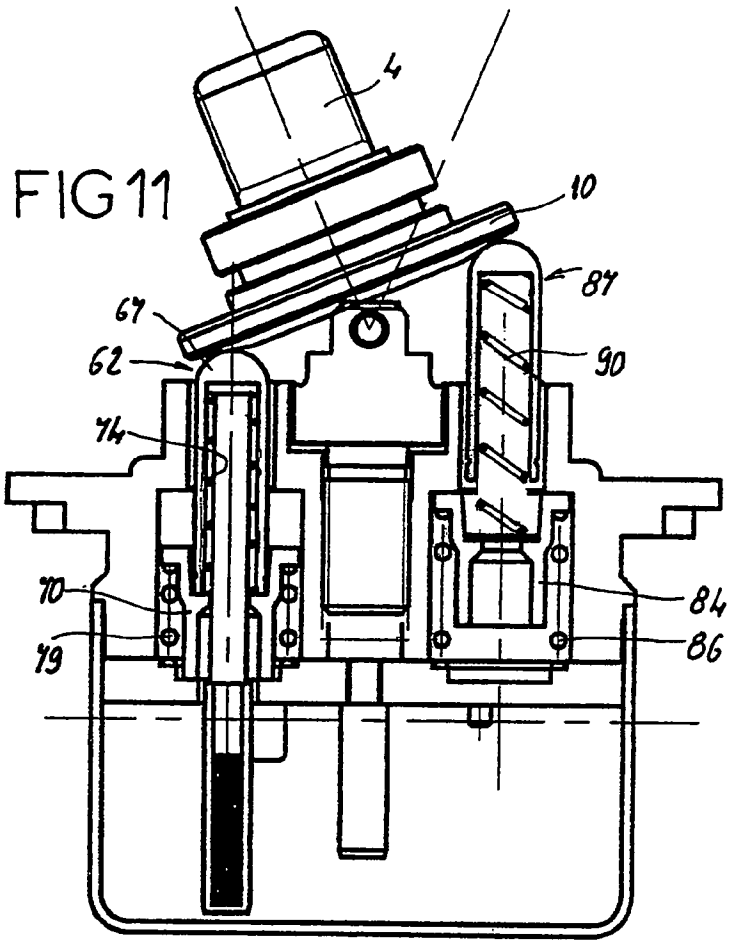
FIG. 11 is a view similar to that of FIG. 10, the handle having been pivoted to move the first pushrod into its depressed position.

According to a third embodiment depicted in FIGS. 10 to 12, all the component parts are identical to the second embodiment except for the second pushrod 87 which in the same way comprises a head end 88 and a portion 89. However, the head end and the portion are not secured to one another, a compression spring 90 being housed between the head end 88 and the portion 89, in a similar-way to the first pushrod. In this case, the head end 88 of the second pushrod 87 follows the skirt 10 of the handle 4.

This arrangement improves the symmetry of the assembly, avoiding assembly errors, and in addition guarantees that a couple in the handle will be symmetric between the depressed and protruding positions.

Of course, the invention is not restricted to the examples described hereinabove and various modifications can be made thereto without departing from its scope.

The invention claimed is:

1. A remote control for a heavy construction machine comprising:

a body which comprises at least one cavity running between an open end opening onto at least a top face of the body and a bottom at the opposite end to the open end, at least one first pushrod which runs between a head end and a foot end, which is mounted to slide back and forth in said at least one cavity of the body in an axial direction between a rest position and a depressed position, and which is intended to control at least a first receiver external to the remote control, and a handle which comprises a transverse skirt and which is mounted to pivot with respect to the body opposite the top face of said body to control the back and forth movement of said first pushrod, the skirt simply resting against the head end of said pushrod, and the axis (Y-Y) of the handle making a variable acute angle with the axis (X-X) of the pushrod, wherein the handle extends parallel to the axis of the pushrod when the pushrod is in the rest position, wherein at least the head end of the first pushrod can also move toward a protruding position which is on the opposite side of said rest position to the depressed position, first elastic return means urge the head end of the pushrod toward its protruding position so that at least the head end of the first pushrod has an autonomous upward movement, the head (12, 67) of the first push rod (3, 62) has an autonomous rising movement to follow the skirt (10) when the handle (4) is swiveled, and the remote control further comprises detection means for detecting every position occupied by the head end of the first pushrod comprising a rest position, a depressed position, and a protruding position occupied by the head end of the first pushrod between its withdrawn and pushed-down positions.

2. The remote control as claimed in claim 1, wherein the detection means are free of mechanical contact.

3. The remote control as claimed in claim 2, wherein the detection means comprise a magnet which moves as one with the head end of the pushrod.

4. The remote control as claimed in claim 1, wherein the cavity is stepped and comprises a first shoulder substantially transverse to the movement of the first pushrod, and in that said pushrod comprises an intermediate portion which moves as one with the head end and the foot end of the pushrod and is located between its head end and its foot end and delimits a top stop and a bottom stop, the top stop coming to rest against the first shoulder when the pushrod is in the protruding position and the bottom stop coming to rest against the bottom of the cavity when said pushrod is in the depressed position.

5. The remote control as claimed in claim 4, wherein the first return means are housed in the cavity.

6. The remote control as claimed in claim 4, wherein the first return means comprise a collar borne by the intermediate portion near the top stop and a first compression spring inserted between the collar and the bottom of the cavity.

7. The remote control as claimed in claim 1, wherein the cavity comprises a shoulder substantially transverse to the movement of the first pushrod, and in that said pushrod comprises a head end and a foot end that move together as one and are able to move translationally along the axis (X-X) of the pushrod with respect to an intermediate portion which is situated between the head end and the foot end and delimits a top stop and a bottom stop, the top stop coming to rest against the shoulder when the head end of the pushrod is between its rest position and its protruding position and the bottom stop coming to rest against the bottom of the cavity when said pushrod is in the depressed position.

8. The remote control as claimed in claim 7, wherein the first elastic return means are housed between the head end of the pushrod and the intermediate portion of the pushrod.

9. The remote control as claimed in claim 7, wherein the first elastic return means comprise a first compression spring inserted between the head end of the pushrod and the intermediate portion of the pushrod.

10. The remote control as claimed in claim 1, wherein second elastic return means are housed in the cavity to return the first pushrod from its depressed position to its rest position.

11. The remote control as claimed in claim 10, wherein the second return means comprise a ring concentric with the first pushrod, a second compression spring inserted between the ring and the bottom of the cavity, and a peripheral relief moving as one with the first pushrod and intended to come to rest against the ring, the cavity further comprising a second shoulder against which the ring abuts when the first pushrod is in the rest position.

12. The remote control as claimed in claim 10, wherein the second return means comprise a collar borne by the intermediate portion near the top stop and a second compression spring inserted between the collar and the bottom of the cavity.

13. The remote control as claimed in claim 1, wherein a second pushrod is mounted in a second cavity of the body, the second pushrod being elastically urged by a third compression spring in such a way that the force that has to be exerted on the handle in order to depress one of the first and second pushrods is more or less constant.

14. The remote control as claimed in claim 13, wherein the second cavity is symmetric with the first cavity with respect to the axis of the handle in the rest position.

15. The remote control as claimed in claim 13, wherein at least the head end of the second pushrod is able to move toward a protruding position which is on the opposite side of said rest position to the depressed position and in that elastic return means urge the head end of the pushrod toward its protruding position so that at least the head end of the second pushrod has an autonomous upward movement.

16. The remote control as claimed in claim 1, wherein the foot end of the first pushrod is mounted such that it passes through the bottom of the cavity and internally bears a magnet.

17. The remote control as claimed in claim 16, wherein a Hall-effect sensor is mounted in the body of the remote control facing the movement of the magnet between the depressed and protruding positions of the first pushrod.

18. The remote control as claimed in claim 13, wherein the second pushrod is located on the opposite side of the axis of the handle to the first pushrod.

19. The remote control as claimed in claim 17, wherein the Hall-effect sensor is potted in resin so that it is situated in a sealed location.

* * * * *